US005918658A

United States Patent [19]

Schartner

[11] Patent Number: 5,918,658

[45] Date of Patent: Jul. 6, 1999

[54] RETRACTABLE BLIND PULL

[76] Inventor: Elena E. Schartner, 71 Broad Brook Rd., Bedford Hills, N.Y. 10507

[21] Appl. No.: 08/992,565

[22] Filed: Dec. 17, 1997

[51] Int. Cl.[6] ..... E06B 9/30

[52] U.S. Cl. ..... 160/178.1 R; 160/173 R; 160/177 R; 160/167.1 R; 242/385.2

[58] Field of Search ..... 160/168.1 R, 173 R, 160/177 R, 178.1 R, 84 R; 242/388, 395, 376, 385.2

[56] References Cited

U.S. PATENT DOCUMENTS

| | | | |
|---|---|---|---|
| 3,438,595 | 4/1969 | Brown et al. | 242/96 |
| 4,271,893 | 6/1981 | McCluskey | 160/178 R |
| 4,463,830 | 8/1984 | Geurtsen | 182/238 |
| 4,466,581 | 8/1984 | Hill | 242/96 |
| 4,802,638 | 2/1989 | Burger et al. | 242/85.1 |
| 5,002,236 | 3/1991 | Cotter | 242/74 |
| 5,279,473 | 1/1994 | Rozon | 242/107.12 R X |
| 5,630,456 | 5/1997 | Hugo et al. | 160/178.1 |
| 5,699,975 | 12/1997 | Paugh et al. | 242/371 |
| 5,762,281 | 6/1998 | Foley | 242/376 X |

*Primary Examiner*—Daniel P. Stodola
*Assistant Examiner*—Bruce A. Lev

[57] ABSTRACT

A new retractable blind pull for automatically retracting a cord after use. The retractable blind pull includes a cylindrical housing having a front face, a back face and a cylindrical side wall therebetween. The cylindrical side wall has an aperture therethrough exposing a hollow interior. The aperture receives a free end of a mini-blind cord therein. A spool is rotatably disposed within the hollow interior of the cylindrical housing between the front and back face thereof. The spool includes a forward flange, an intermediate flange and a back flange. A space between the forward flange and the intermediate flange is disposed below the aperture in the cylindrical side wall of the cylindrical housing with the mini-blind cord wrapping around the spool between the forward flange and the intermediate flange. A coil spring is wrapped around the spool between the intermediate flange and the back flange for rotation of the spool thereby retracting the mini-blind cord therearound. A lock button is slidably received through the front face of the cylindrical housing and the spool for selectively engaging the spool.

4 Claims, 2 Drawing Sheets

FIG 1
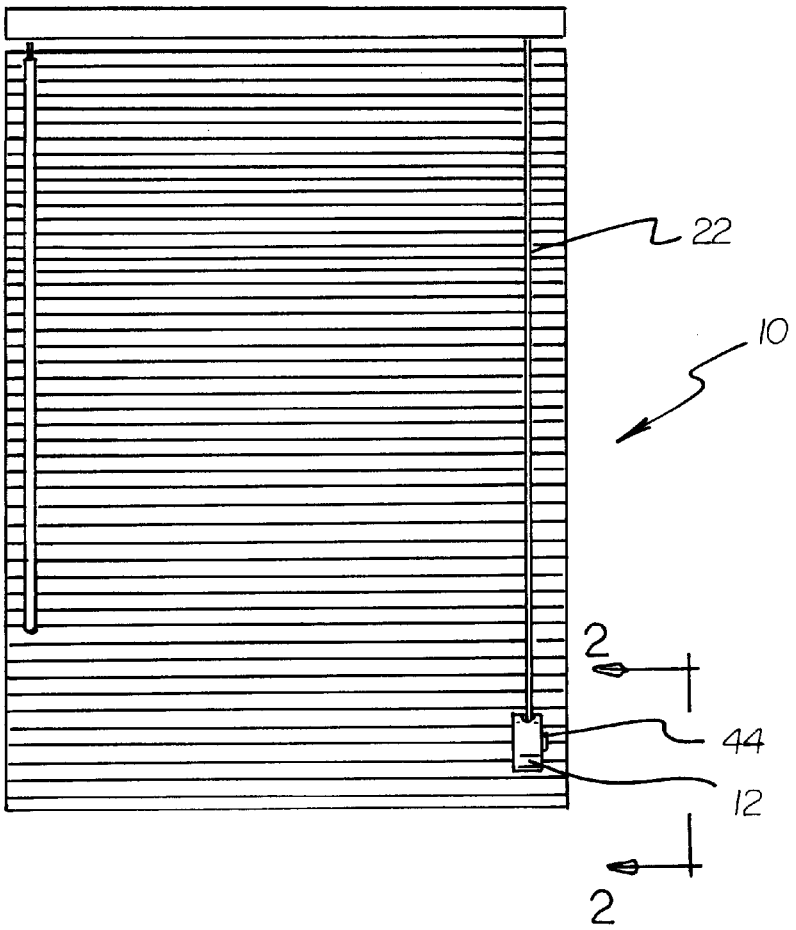
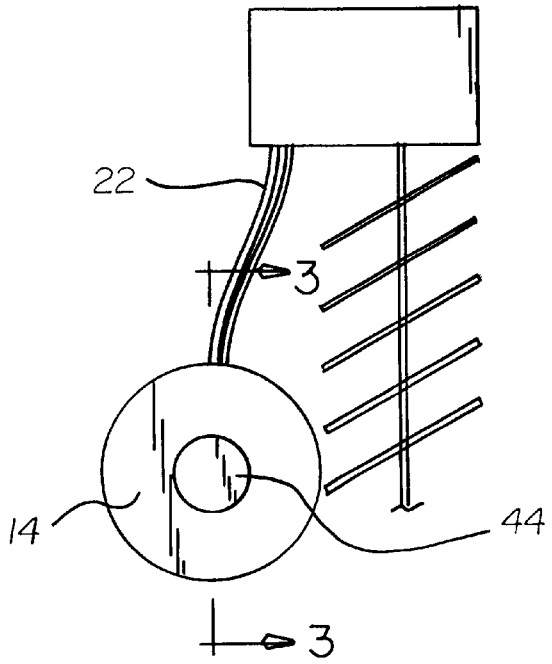
FIG 2

RETRACTABLE BLIND PULL

BACKGROUND OF THE INVENTION

1. Field of the Invention

The present invention relates to cord retraction devices and more particularly pertains to a new retractable blind pull for automatically retracting a cord after use.

2. Description of the Prior Art

The use of cord retraction devices is known in the prior art. More specifically, cord retraction devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art cord retraction devices include U. S. Pat. No. 5,279,473 to Rozon; U.S. Pat. No. 4,271,893 to McCluskey; U.S. Pat. No. Des. 353,503 to Belue; U.S. Pat. No. 4,909,298 to Langhart et al.; U.S. Pat. No. 4,802,638 to Burger et al.; and U.S. Pat. No. 4,466,581 to Hill.

While these devices fulfill their respective, particular objectives and requirements, the aforementioned patents do not disclose a new retractable blind pull. The inventive device includes a cylindrical housing having a front face, a back face and a cylindrical side wall therebetween. The cylindrical side wall has an aperture therethrough exposing a hollow interior. The aperture receives a free end of a mini-blind cord therein. A spool is rotatably disposed within the hollow interior of the cylindrical housing between the front and back face thereof. The spool includes a forward flange, an intermediate flange and a back flange. A space between the forward flange and the intermediate flange is disposed below the aperture in the cylindrical side wall of the cylindrical housing with the mini-blind cord wrapping around the spool between the forward flange and the intermediate flange. A coil spring is wrapped around the spool between the intermediate flange and the back flange for rotation of the spool thereby retracting the mini-blind cord therearound. A lock button is slidably received through the front face of the cylindrical housing and the spool for selectively engaging the spool.

In these respects, the retractable blind pull according to the present invention substantially departs from the conventional concepts and designs of the prior art, and in so doing provides an apparatus primarily developed for the purpose of automatically retracting a cord after use.

SUMMARY OF THE INVENTION

In view of the foregoing disadvantages inherent in the known types of cord retraction devices now present in the prior art, the present invention provides a new retractable blind pull construction wherein the same can be utilized for automatically retracting a cord after use.

The general purpose of the present invention, which will be described subsequently in greater detail, is to provide a new retractable blind pull apparatus and method which has many of the advantages of the cord retraction devices mentioned heretofore and many novel features that result in a new retractable blind pull which is not anticipated, rendered obvious, suggested, or even implied by any of the prior art cord retraction devices, either alone or in any combination thereof.

To attain this, the present invention generally comprises a cylindrical housing having a front face, a back face and a cylindrical side wall therebetween. The cylindrical side wall has an aperture therethrough exposing a hollow interior. The aperture receives a free end of a mini-blind cord therein. The front face has an aperture through a central portion thereof. The aperture in the front face has radially extending recesses in communication therewith disposed along ninety degree intervals. A spool is rotatably disposed within the hollow interior of the cylindrical housing between the front and back face thereof. The spool includes a forward flange, an intermediate flange and a back flange. A space between the forward flange and the intermediate flange is disposed below the aperture in the cylindrical side wall of the cylindrical housing with the mini-blind cord wrapping around the spool between the forward flange and the intermediate flange. A coil spring is wrapped around the spool between the intermediate flange and the back flange for rotation of the spool thereby retracting the mini-blind cord therearound. A forward end of the spool has a recess extending inwardly thereof. The recess is in alignment with the aperture in the front face of the cylindrical housing. An inner end of the recess has an interior spring positioned therein. A lock button is slidably received through the aperture in the front face of the cylindrical housing and the recess in the forward end of the spool. The lock button includes an inner shaft portion and outer button portion. The inner shaft portion is slidably disposed within the recess of the spool and is secured to the interior spring. The inner shaft portion has radially disposed protuberances on an inner end thereof corresponding with the radially extending recesses of the aperture in the front face of the cylindrical housing. The inner shaft portion is biased outwardly by the interior spring in an inoperative orientation whereby the protuberances engage the radially extending recesses to preclude rotation of the spool. Pushing inwardly on the outer button portion will compress the interior spring thereby sliding the inner shaft portion inwardly thereby disengaging the protuberances from the radially extending recesses thereby allowing the coil spring to rotate the spool and retract the mini-blind cord.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new retractable blind pull apparatus and method which has many of the advantages of the cord retraction devices mentioned heretofore and many novel features that result in a new retractable blind pull which is not anticipated, rendered obvious, suggested, or even implied by any of the prior art cord retraction devices, either alone or in any combination thereof.

It is another object of the present invention to provide a new retractable blind pull which may be easily and efficiently manufactured and marketed.

It is a further object of the present invention to provide a new retractable blind pull which is of a durable and reliable construction.

An even further object of the present invention is to provide a new retractable blind pull which is susceptible of a low cost of manufacture with regard to both materials and labor, and which accordingly is then susceptible of low prices of sale to the consuming public, thereby making such retractable blind pull economically available to the buying public.

Still yet another object of the present invention is to provide a new retractable blind pull which provides in the apparatuses and methods of the prior art some of the advantages thereof, while simultaneously overcoming some of the disadvantages normally associated therewith.

Still another object of the present invention is to provide a new retractable blind pull for automatically retracting a cord after use.

Yet another object of the present invention is to provide a new retractable blind pull which includes a cylindrical housing having a front face, a back face and a cylindrical side wall therebetween. The cylindrical side wall has an aperture therethrough exposing a hollow interior. The aperture receives a free end of a mini-blind cord therein. A spool is rotatably disposed within the hollow interior of the cylindrical housing between the front and back face thereof. The spool includes a forward flange, an intermediate flange and a back flange. A space between the forward flange and the intermediate flange is disposed below the aperture in the cylindrical side wall of the cylindrical housing with the mini-blind cord wrapping around the spool between the forward flange and the intermediate flange. A coil spring is wrapped around the spool between the intermediate flange and the back flange for rotation of the spool thereby retracting the mini-blind cord therearound. A lock button is slidably received through the front face of the cylindrical housing and the spool for selectively engaging the spool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of a new retractable blind pull according to the present invention illustrated in use.

FIG. 2 is a front view of the present invention illustrated in use.

DESCRIPTION OF THE PREFERRED EMBODIMENT

Figure 3:
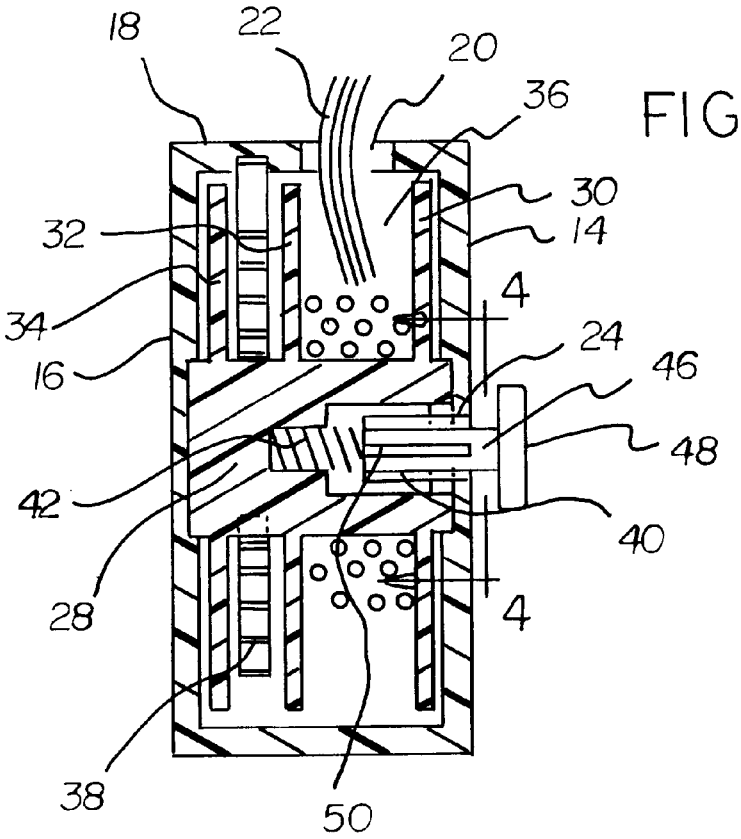
FIG. 3 is a cross-sectional view of the present invention as taken along line 3—3 of FIG. 2.
Figure 4:
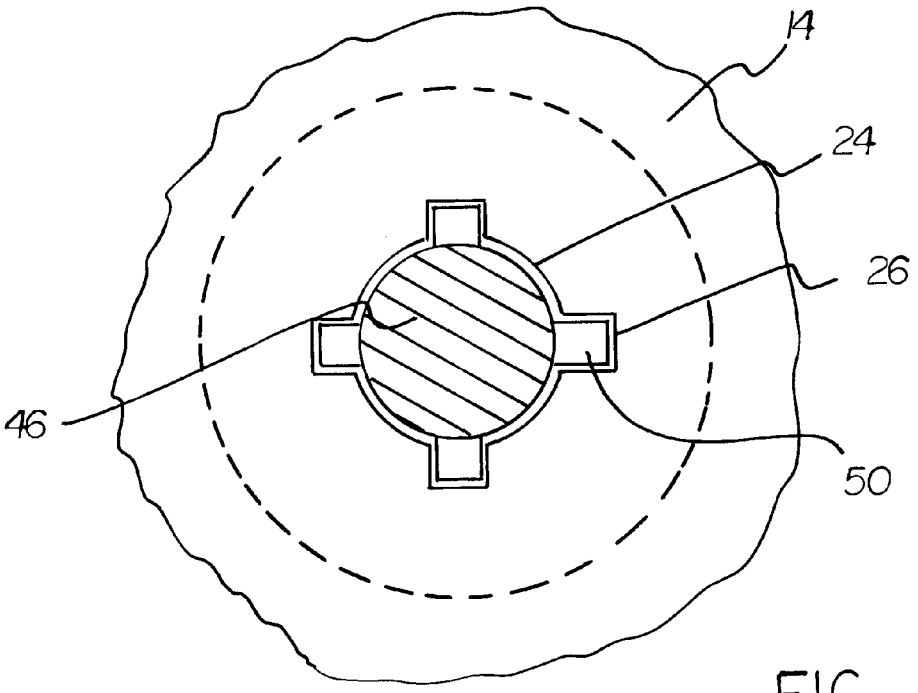
FIG. 4 is a cross-sectional view of the present invention as taken along line 4—4 of FIG. 3.

With reference now to the drawings, and in particular to FIGS. 1 through 4 thereof, a new retractable blind pull embodying the principles and concepts of the present invention and generally designated by the reference numeral 10 will be described.

As best illustrated in FIGS. 1 through 4, the retractable blind pull 10 comprises a cylindrical housing 12 having a front face 14, a back face 16 and a cylindrical side wall 18 therebetween. The cylindrical side wall 18 has an aperture 20 therethrough exposing a hollow interior. The aperture 20 receives a free end of a mini-blind cord 22 therein. The front face 14 has an aperture 24 through a central portion thereof. The aperture 24 in the front face 14 has radially extending recesses 26 in communication therewith disposed along ninety degree intervals.

A spool 28 is rotatably disposed within the hollow interior of the cylindrical housing 12 between the front 14 and back face 16 thereof. The spool 28 includes a forward flange 30, an intermediate flange 32 and a back flange 34. A space 36 between the forward flange 30 and the intermediate flange 32 is disposed below the aperture 20 in the cylindrical side wall 18 of the cylindrical housing 12 with the mini-blind cord 22 wrapping around the spool 28 between the forward flange 30 and the intermediate flange 32. A coil spring 38 is wrapped around the spool 28 between the intermediate flange 32 and the back flange 34 for rotation of the spool 28 thereby retracting the mini-blind cord 22 therearound. A forward end of the spool 28 has a recess 40 extending inwardly thereof. The recess 40 is in alignment with the aperture 24 in the front face 14 of the cylindrical housing 12. An inner end of the recess 40 has an interior spring 42 positioned therein.

A lock button 44 is slidably received through the aperture 24 in the front face 14 of the cylindrical housing 12 and the recess 40 in the forward end of the spool 28. The lock button 44 includes an inner shaft portion 46 and outer button portion 48. The inner shaft portion 46 is slidably disposed within the recess 40 of the spool 28 and is secured to the interior spring 42. The inner shaft portion 46 has radially disposed protuberances 50 on an inner end thereof corresponding with the radially extending recesses 26 of the aperture 24 in the front face 14 of the cylindrical housing 12. The inner shaft portion 46 is biased outwardly by the interior spring 42 in an inoperative orientation whereby the protuberances 50 engage the radially extending recesses 26 to preclude rotation of the spool 28. Pushing inwardly on the outer button portion 48 will compress the interior spring 42 thereby sliding the inner shaft portion 46 inwardly thereby disengaging the protuberances 50 from the radially extending recesses 26 thereby allowing the coil spring 38 to rotate the spool 28 and retract the mini-blind cord 22.

In use, the present invention would retract the cord 22 of the mini-blind after appropriate adjustment of the blinds.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A retractable blind pull and cord system comprising, in combination:

a blind having an upper housing and a mini-blind cord coupled thereto, a first portion of the mini-blind cord extending downwardly from the upper housing and having a plurality of uniformly spaced blind slats coupled thereto, a second portion of the mini-blind cord downwardly extending from the upper housing of the blind;

a cylindrical housing having a front face, a back face and a cylindrical side wall therebetween, the cylindrical side wall having an aperture therethrough exposing a hollow interior, the aperture receiving a free end of the second portion of the mini-blind cord therein, the front face having an aperture through a central portion thereof, the aperture in the front face having radially extending recesses in communication therewith disposed along ninety degree intervals;

a spool rotatably disposed within the hollow interior of the cylindrical housing between the front and back face thereof, the spool including a forward flange, an intermediate flange and a back flange extending from an outer surface thereof, a space between the forward flange and the intermediate flange being disposed below the aperture in the cylindrical side wall of the cylindrical housing with the mini-blind cord wrapping around the outer surface of the spool between the forward flange and the intermediate flange, a coil spring wrapped around the outer surface of the spool between the intermediate flange and the back flange for rotation of the spool thereby retracting the mini-blind cord therearound, an outer diameter of the outer surface of the spool between the forward and intermediate flanges being substantially the same as an outer diameter of the outer surface of the spool between the intermediate and back flanges, a forward end of the spool having a recess extending inwardly thereof, the recess being in alignment with the aperture in the front face of the cylindrical housing, an inner end of the recess having an interior spring positioned therein; and a lock button centrally positioned on the front face of the cylindrical housing and being slidably received through the aperture in the front face of the cylindrical housing and the recess in the forward end of the spool, the lock button including an inner shaft portion and outer button portion, the inner shaft portion being slidably disposed within the recess of the spool, an end of the inner shaft portion of the lock button being secured to the interior spring, the interior spring having an outer diameter substantially equal to the outer diameter of the inner shaft, the interior spring being coaxial with the inner shaft portion of the lock button, the inner shaft portion having radially disposed protuberances on an inner end thereof corresponding with the radially extending recesses of the aperture in the front face of the cylindrical housing, the inner shaft portion being biased outwardly by the interior spring in an inoperative orientation whereby the protuberances engaging the radially extending recesses to preclude rotation of the spool, pushing inwardly on the outer button portion will compress the interior spring thereby sliding the inner shaft portion inwardly thereby disengaging the protuberances from the radially extending recesses thereby allowing the coil spring to rotate the spool and retract the mini-blind cord.

2. A retractable blind pull with a retractable cord comprising, in combination:

a cylindrical housing having a front face, a back face and a cylindrical side wall therebetween, the cylindrical side wall having an aperture therethrough exposing a hollow interior, the aperture receiving a free end of a mini-blind cord therein;

a spool rotatably disposed within the hollow interior of the cylindrical housing between the front and back face thereof, the spool including a forward flange, an intermediate flange and a back flange extending from an outer surface thereof, a space between the forward flange and the intermediate flange being disposed below the aperture in the cylindrical side wall of the cylindrical housing with the mini-blind cord wrapping around the outer surface of the spool between the forward flange and the intermediate flange, a coil spring wrapped around the outer surface of the spool between the intermediate flange and the back flange for rotation of the spool thereby retracting the mini-blind cord therearound; and a lock button slidably received through the front face of the cylindrical housing and the spool for selectively engaging the spool.

3. The retractable blind pull as set forth in claim 2 wherein the lock button is slidably received through an aperture in the front face of the cylindrical housing and a recess in a forward end of the spool, the lock button including an inner shaft portion and outer button portion, the inner shaft portion being slidably disposed within the recess of the spool and secured to an interior spring within the recess.

4. The retractable blind pull as set forth in claim 3 wherein the inner shaft portion has radially disposed protuberances on an inner end thereof corresponding with radially extending recesses of the aperture in the front face of the cylindrical housing, the inner shaft portion being biased outwardly by the interior spring in an inoperative orientation whereby the protuberances engaging the radially extending recesses to preclude rotation of the spool, pushing inwardly on the outer button portion will compress the interior spring thereby sliding the inner shaft portion inwardly thereby disengaging the protuberances from the radially extending recesses thereby allowing the coil spring to rotate the spool and retract the mini-blind cord.

* * * * *